United States Patent [19]

Goloff

[11] 3,966,366

[45] June 29, 1976

[54] DEFLECTION COMPENSATION FOR SLANT AXIS ROTARY MECHANISMS

[75] Inventor: Alexander Goloff, East Peoria, Ill.

[73] Assignee: Caterpillar Tractor Co., Peoria, Ill.

[22] Filed: Sept. 25, 1975

[21] Appl. No.: 616,787

[52] U.S. Cl. ..... 418/53; 418/182

[51] Int. Cl.[2] ..... F04B 1/16

[58] Field of Search ..... 418/49–53, 418/182

[56] References Cited

UNITED STATES PATENTS

| | | | |
|---|---|---|---|
| 2,960,074 | 11/1950 | Zauada | 418/50 |
| 3,019,964 | 2/1962 | Griswold | 418/182 |
| 3,465,682 | 9/1969 | Hartmann | 418/182 |
| 3,697,201 | 10/1972 | Eickmann | 418/182 |
| 3,698,246 | 10/1972 | Rittenhouse | 418/49 |
| 3,816,037 | 6/1974 | Germain | 418/53 |

*Primary Examiner*—C. J. Husar

*Attorney, Agent, or Firm*—Ralph E. Walters

[57] ABSTRACT

An improved slant axis rotary mechanism including a housing defining an operating chamber. A shaft is journalled in the housing and has an angularly offset portion within the chamber. The shaft is slightly axially movable with respect to the housing. A rotor is within the chamber and journalled on the angularly offset portion of the shaft. A system is provided for cyclically axially oscillating the shaft during operation of the mechanism to compensate for component deflection during such operation to thereby maximize the attainable compression ratio and improve performance of the mechanism.

11 Claims, 5 Drawing Figures

DEFLECTION COMPENSATION FOR SLANT AXIS ROTARY MECHANISMS

BACKGROUND OF THE INVENTION

This invention relates to slant axis rotary mechanisms, such as slant axis rotary engines and, more particularly, to the provision in such mechanisms of means for compensating for rotor deflection relative to the housing during operation so as to maximize compression ratios attainable and achieve maximum efficiency of operation.

In slant axis rotary mchanisms, such as a slant axis rotary engine, it is highly desirable to minimize the clearance between rotor parts and the walls of the operating chamber defined by the housing when the rotor is in a so-called "top dead center position". A frequent goal is to maintain such clearances in the range of 0.13 to 0.26 mm. Such clearances are difficult to achieve due to high gas pressures in the mechanism, particularly when the pressures are enhanced by combustion when the mechanism is used as an engine. For example, when a typical operating pressure as, 1200 psi, is present, one can reliably expect the presence of a 0.05 mm deflection in the housing, an identical deflection in the rotor in an axial direction and in the rotor thrust bearing structure. A deflection of approximately half the foregoing magnitude will occur in the shaft and the shaft thrust bearing housing. A deflection of approximately one-fourth of the housing deflection can be expected at the thrust bearing collar of the shaft.

Consequently, a total deflection on the order of 0.21 mm. will occur each time the mechanism is fired. Since, in slant axis rotary engines, firing occurs on both sides of a rotor flange, such movement will occur to each side of the mean rotor position.

For a lesser situation, when, for example, such a mechanism is employed as an engine and is idling, the gas pressures are lower and a total of approximately 0.14 mm deflection is present.

Thus, the deflections due to gas pressure are of the same magnitude as the minimum design clearance desired. As a consequence, interference between the rotor and the housing will not occur only if the parts are perfectly fabricated, that is, manufacturing tolerances are zero. Since a manufacturing tolerance equal to zero is impossible, in a practical sense, to achieve, it has heretofore been necessary to operate outside of the desired minimum clearance range with the consequence that compression ratios are lowered and parasitic volume is increased. Thus, mechanism efficiency is similary decreased.

SUMMARY OF THE INVENTION

It is the principal object of the invention to provide a new and improved slant axis rotary mechanism. More specifically, it is an object of the invention to provide such a mechanism with compensation for rotor deflection whereby minimum rotor to housing clearance can be achieved without interference during operation to increase efficiency of operation of the mechanism.

The exemplary embodiment of the invention achieves the foregoing object in a structure including a housing defining an operating chamber. A shaft is journalled in the housing and has an angularly offset portion within the chamber. The shaft is slightly axially movable with respect to the housing. A rotor is within the chamber and journalled on the angularly offset portion and means are provided for cyclically axially oscillating the shaft during operation of the mechanism in a direction opposite the deflection to compensate for such deflection.

According to a highly preferred embodiment of the invention, the shaft carries a thrust collar and the oscillating force is applied to the thrust collar.

According to a highly preferred embodiment of the invention, the force is applied to the thrust collar through the medium of a hydraulic fluid under pressure. According to one embodiment of the invention, the application of hydraulic fluid is timed by a rotary valve operatively associated with the mechanism shaft for alternately directing hydraulic fluid to opposite sides of the thrust collar and for establishing a pressure relief path from each side of the thrust collar when the other side is being subjected to hydraulic fluid under pressure.

According to other embodiments of the invention, the force applying means comprises a cam operated hydraulic pump and timing is achieved by a cam driven by the shaft which operates the pump. The pump may comprise a pair of plungers, each in fluid communication with a source of hydraulic fluid and with a corresponding side of the thrust collar.

According to a highly preferred embodiment of the invention, means are provided for sensing the loading on the mechanism and means are included which are responsive to the sensing means for altering the stroke of the plunger proportionally to the sensed load.

Other objects and advantages will become apparent from the following specification taken in connection with the accompanying drawings.

DESCRIPTION OF THE PREFERRED EMBODIMENTS

Figure 1:
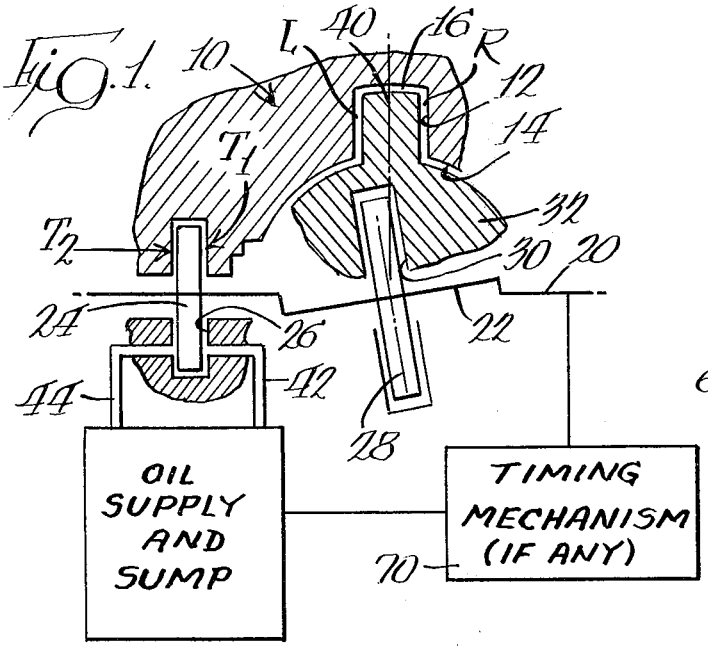
FIG. 1 is a fragmentary, somewhat schematic, sectional view of a slant axis rotary mechanism embodying the invention.

An exemplary embodiment of a slant axis rotary mechanism made according to the invention is illustrated in FIG. 1 and is seen to include a housing, generally designated 10, of conventional construction and having interior walls 12, 14 and 16 which define an operating chamber.

A shaft, shown schematically at 20, includes an angularly offset portion 22 within the operating chamber defined by the walls 12, 14 and 16. The shaft 20 is journalled by any suitable means in the housing. The shaft 20 also carries, at one end thereof, a thrust collar 24 received in a thrust bearing 26, formed in the housing 10.

The angularly offset portion 22 of the shaft 20 also carries a thrust collar 28 which is received in suitable thrust bearings 30 in a rotor 32 disposed within the operating chamber and journalled on the shaft 20.

As is well known, when a slant axis rotary mechanism is employed as an engine, the same will include two firing areas, one on each side of the rotor flange 40. Such firing areas are designated L and R in FIG. 1. When the mechanism is employed for other purposes as, for example, a pump or compressor, maximum pressures will exist in the same two areas. As can be appreciated, such pressures will alternately tend to shift the rotor 32 axially along the axis of the shaft 20 while driving the housing 10 in the opposite direction. As alluded to previously, such deflection can cause interference between the rotor and the housing during operation unless the rotor is made undersize with greater than desired clearances resulting in lowered compression ratio and the creation of increased parasitic volume. For example, if the firing area L is pressurized, and minimum desired design clearances are present, the right-hand side of the rotor flange 40 opposite from the area L will engage the wall 12 in the vicinity of the right-hand firing area R. For pressurization of the area R, the converse will occur in the area L.

To compensate for such deflection, without decreasing compression ratios through the use of an undersized rotor, the invention contemplates axially shifting the shaft 20 an amount sufficient to preclude such interference from occurring. Typically, the minimum desired shifting will be on the order of the minimum deflection expected for any type of mechanism operation. For the example herein given under the heading "Background of the Invention", the shifting would be on the order of 0.14 mm.

Such axial shifting is accomplished by alternately applying forces to opposite sides of the thrust collar 24 and by providing a clearance in the thrust bearing 26 equal to the minimum desired compensation. Such clearance is illustrated in FIG. 1 in greatly exaggerated form.

Preferably, the application of force to the thrust collar 24 is accomplished through the application of hydraulic fluid under pressure thereto.

Thus, as seen in FIG. 1, a conduit 42 in the housing 10 opens to one side $T_1$ of the thrust collar 24, while a second conduit 44 opens to the opposite side, $T_2$, of the thrust collar 24, both within the thrust bearing 26. The conduits 42 and 44 are connected to an oil supply and sump which, in turn, is operated in timed relation with the mechanism during its operation. When the mechanism is employed as an engine, the sequencing is as follows. Each time the combustion area L is fired, hydraulic fluid under pressure is charged through the conduit 42 to axially shift the shaft 20 to the left, as viewed in FIG. 1, through the design clearance of the thrust bearing 26. At the same time, pressure is relieved in the conduit 44. Each time the combustion area R is fired, the opposite will occur.

Figure 2:
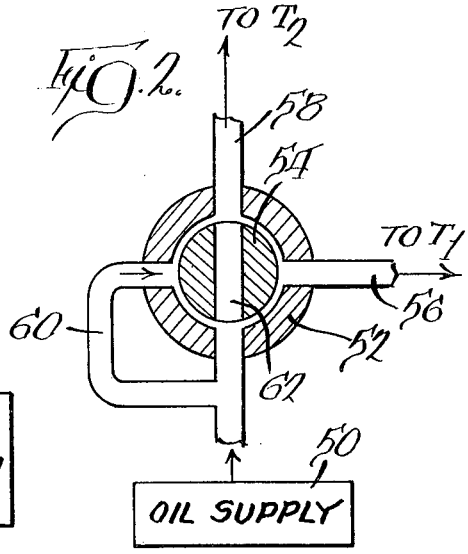
FIG. 2 is a sectional view of a timing valve employed in connection with the invention.
Figure 3:
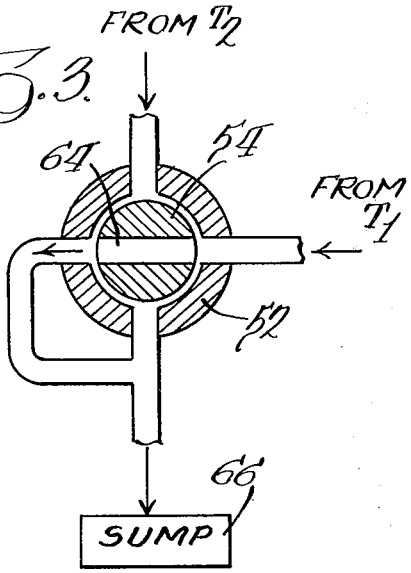
FIG. 3 is a sectional view of the timing valve.

FIGS. 2 and 3 illustrate one means for achieving such timing. The means include a source of hydraulic fluid under pressure, designated 50. The pressure of the hydraulic fluid emanating from the source 50 will be determined by the effective area of the thrust collar 24 exposed to such fluid, as well as by the pressures generated in the firing areas L and R and the area of the surfaces to which they are applied.

The source is connected to the stationary barrel 52 of a rotary timing valve having an internal rotor 54. A conduit 56 from the barrel is connected to the conduit 42, while a conduit 58 from the barrel is connected to the conduit 44. In addition, on the source side of the flow system, a conduit 60 extends from the oil supply to the interior of the barrel 52.

The rotor 54 includes a cross bore 62 which is operative to establish fluid communication between the source 50 and either the conduit 42 or 44 for every 90 degress of rotation. As seen in FIG. 3, the rotor 54 includes an axially spaced cross bore 64 oriented at approximately 90° to the cross bore 62 for establishing fluid communication to a sump 66. The arrangement is such that when fluid under pressure is being directed to the conduit 42, the conduit 44 will be communicating with the sump. Similarly, when fluid under pressure is being directed to the conduit 44, the conduit 42 will be connected to the sump.

If the mechanism is a four-cycle engine, for each revolution of the rotor 32, six firings will occur, three in the left area L and three in the right area R. At the same time, the shaft 20 will have rotated through three complete revolutions. Thus, according to the embodiment of the invention illustrated in FIGS. 2 and 3, the rotor 54 of the valve is operatively connected to the shaft 20 by any suitable timing mechanism, such as that illustrated schematically at 70 to rotate at one-half the speed of the shaft 20. And, of course, upon initial assembly of the mechanism, the rotor 54 is properly oriented with respect to the conduits and the source such that fluid communication to either of the conduits 42 and 44 will occur when one side or the other of the rotor is at top dead center in such a way that the force applied to the thrust collar 24 will be opposite that applied to the rotor at top dead center.

Figure 4:
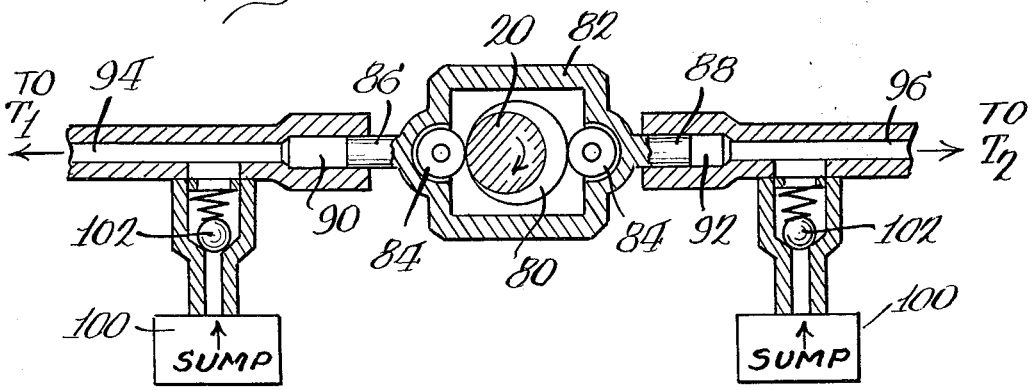
FIG. 4 is a sectional view of a modified pressure source and timing means employed in the invention.

FIG. 4 illustrates a preferred embodiment of a system for supplying hydraulic fluid under pressure to the conduits 42 and 44. The shaft 20 is provided with a cam 80 disposed in the center of a lifter hook 82. The lifter hook 82 carries a pair of rollers 84 for engagement with the cam 80 as well as two oppositely directed plungers 86 and 88. Each of the plungers 86 and 88 is reciprocally received within an associated bore 90 and 92 to define a hydraulic pump. The bore 90 is connected via a conduit 94 to the conduit 42, while the bore 92 is connected via a similar conduit 96 to the conduit 44. Each of the conduits 94 and 96 is provided with an opening to a source of make-up oil or sump 100 via a check valve 102 arranged to permit fluid flow from the sump 100 to the conduit but not the reverse.

As a consequence of the foregoing construction, as the shaft 20 rotates, one of the plungers 86 or 88 will be advanced in its bore 90 or 92 to pressurize hydraulic fluid therein, while the other will be retracted from its bore to relieve pressure in the conduits associated therewith. The system illustrated in FIG. 4 is preferred over that shown in FIGS. 2 and 3 in that since fluid is not returned to the sump as a matter of course, there is a return of the energy to the system not accomplished with the embodiments of FIGS. 2 and 3. Consequently, the system in FIG. 4 increases mechanism efficiency.

Figure 5:
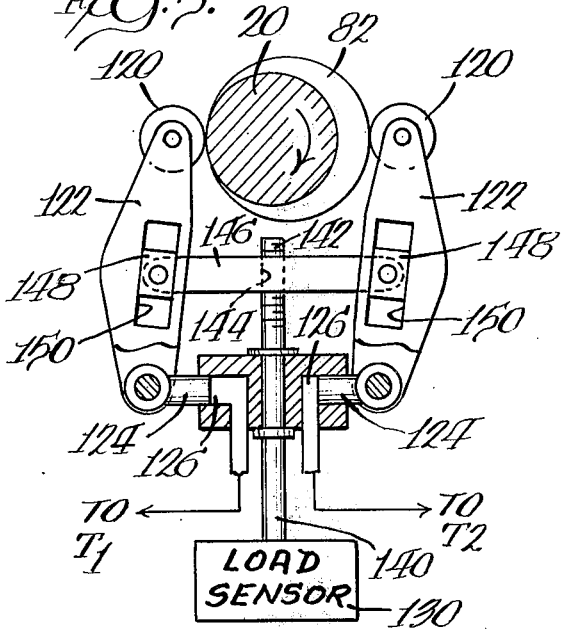
FIG. 5 is a sectional view of still another embodiment of a pressure source and timing mechanism employed in the invention.

FIG. 5 illustrates still a further embodiment of the invention which also employs a cam 82 on the shaft 20. Rollers 120 mounted on ends of rocker arms 122 engage the cam 82. The ends of the rocker arms 122 opposite from the rollers 120 are pivotally connected to plungers 124 reciprocal in bores 126 which may be connected to the conduits 42 and 44 as indicated. In addition, a connection to sump for each of the bores 126 is established via a check valve in the same manner as the check valves 102.

A conventional load sensor 130 is associated with the mechanism for determining the load thereon. As is well known, the load sensor 130 can sense any one or more of a variety of parameters available in the mechanism such as so-called "rack position", peak pressure in the combustion areas L or R, etc. The load sensor 130, depending upon the load sensed, is operable to rotate a shaft 140 having a threaded end 142 received in a bore 144 in an arm 146. The arm 146 is fixed against rotation in any suitable fashion. The arm 146, at its ends, pivotally mounts bearing blocks 148 received in elongated slots 150 in corresponding ones of the rocker arms 122. Thus, by rotation of the shaft 140, the pivot point of each of the rocker arms 122 may be changed to vary the stroke of the associated plunger 124. When the shaft 140 is rotated to advance the arm 146 upwardly, as viewed in FIG. 5, an increased stroke will result, while when the arm 146 is moved downwardly, a decreased stroke will result. Since the ultimate pressure applied to the thrust collar 24 will be dependent upon the length of stroke of the plungers 124, it will be appreciated that the degree of force may be regulated in response to the load sensor 130. In general, the arrangement will be such that as engine load increases, the stroke of the plungers 124 will be correspondingly increased to increase the pressure of the hydraulic fluid applied to the thrust collar 24.

From the foregoing, it will be appreciated that the invention provides for compensation due to axial deflections in the component parts so as to allow fabrication of a slant axis rotary mechanism with desirable clearances, maximizing compression ratio and minimizing parasitic volume. Consequently, through use of the invention, efficiency of the mechanism is vastly increased.

The invention is particularly suited for use in slant axis rotary mechanisms employed as engines, but will find use as well in such mechanisms employed as pumps, compressors, or the like wherein high pressures are encountered.

What is claimed is:

1. A slant axis rotary mechanism comprising:

a housing defining an operating chamber;

a shaft journalled in said housing and having an angularly offset portion within said chamber, said shaft being slightly axially movable with respect to said housing;

a rotor within said chamber and journalled on said angularly offset portion;

and means for cyclically axially oscillating said shaft during operation of said mechanism to compensate for deflection during such operation.

2. A slant axis rotary mechanism comprising:

a. a housing defining an operating chamber;

b. a shaft journalled in said housing and having an angularly offset portion within said chamber and carrying a thrust collar within said housing and exteriorly of said chamber, said shaft and said thrust collar being axially movable in limited amounts with respect to said housing;

c. a rotor within said chamber and journalled on said angularly offset portion; and d. means for cyclically applying an axial shifting force to said thrust collar during operation of said mechanism.

3. The slant axis rotary mechanism of claim 2 wherein said force applying means alternately applies said shifting force to both sides of said thrust collar to axially oscillate said shaft.

4. The slant axis rotary mechanism of claim 3 wherein said force applying means includes a source of hydraulic fluid under pressure.

5. The slant axis rotary mechanism of claim 2 wherein said force applying means includes timing means for applying a force to said thrust collar in a direction opposite to the application of a force applied to said rotor within said operating chamber at the time the force is applied to the rotor.

6. The slant axis rotary mechanism of claim 5 wherein said force applying means comprises a source of hydraulic fluid under pressure and said timing means comprises a rotary valve operatively associated with said shaft to be driven thereby for alternately directing hydraulic fluid to opposite sides of said thrust collar, said valve further establishing a pressure relief path from each side of said thrust collar when the other side thereof is being subjected to hydraulic fluid under pressure.

7. The slant axis rotary mechanism of claim 5 wherein said force applying means comprises cam operated hydraulic pump means and said timing means comprises a cam driven by said shaft for operating said pump means.

8. The slant axis rotary mechanism of claim 7 wherein said hydraulic pump means includes a pair of plungers, each in fluid communication with a source of hydraulic fluid and with a corresponding side of said thrust collar.

9. The slant axis rotary mechanism of claim 7 further including means for sensing the loading on said mechanism; and means responsive to said sensing means for altering the stroke of said plungers proportionally to the sensed loading.

10. The slant axis rotary mechanism of claim 2 further including means for sensing the loading on said mechanism, and means responsive to said sensing means for varying the force applied by said force applying means proportionally to said sensed loading.

11. A slant axis rotary mechanism comprising:

a. a housing defining an operating chamber;

b. a shaft journalled in said housing and having an angularly offset portion within said chamber and carrying a thrust collar within said housing and exteriorly of said chamber, said shaft and said thrust collar being axially movable in limited amounts with respect to said housing;

c. a rotor within said chamber and journalled on said angularly offset portion;

d. a pair of conduits in said housing, one opening on each side of said thrust collar; and e. means for alternately supplying hydraulic fluid under pressure to one of said conduits while relieving pressure in the other of the conduits.

* * * * *